US007044270B1

(12) United States Patent
McIntire et al.

(10) Patent No.: US 7,044,270 B1
(45) Date of Patent: May 16, 2006

(54) POSTING LADDER

(75) Inventors: Kevin McIntire, Stoneboro, PA (US); Roy B. Bendickson, Sharpsville, PA (US)

(73) Assignee: Werner Co.,, Greenville, PA (US)

( * ) Notice: Subject to any disclaimer, the term of this patent is extended or adjusted under 35 U.S.C. 154(b) by 0 days.

(21) Appl. No.: 10/880,347

(22) Filed: Jun. 30, 2004

(51) Int. Cl.
*E06C 1/36* (2006.01)
*E06C 7/14* (2006.01)
*E04G 5/02* (2006.01)

(52) U.S. Cl. ..... 182/206; 182/107; 248/211

(58) Field of Classification Search ..... 182/206, 182/194, 150, 93, 107, 214, 45; 248/210, 248/211, 235, 238
See application file for complete search history.

(56) References Cited

U.S. PATENT DOCUMENTS 297,822 A * 4/1884 Manahan ..... 182/206
869,151 A * 10/1907 Zube ..... 182/206
1,030,905 A * 7/1912 Lucas ..... 182/206
1,205,594 A 11/1916 Close
1,982,572 A * 11/1934 Colglazier et al. ..... 182/206
2,318,943 A * 5/1943 Holmes ..... 182/206
2,448,716 A 9/1948 Hurd
2,872,717 A * 2/1959 Kelley ..... 294/82.19
4,002,223 A * 1/1977 Bernkrant ..... 182/206
4,279,327 A 7/1981 Warren
4,531,613 A 7/1985 Keigher
5,601,154 A * 2/1997 Eisenmenger ..... 182/206
6,167,988 B1 1/2001 Frodge et al.

* cited by examiner

*Primary Examiner*—Hugh B. Thompson, II
(74) *Attorney, Agent, or Firm*—McDermott Will & Emery LLP

(57) ABSTRACT

A hook attachment for a ladder is provided and includes a pair of curved members, each of the curved members being formed in a tapered shape having a base portion of a first cross-sectional area and a tip portion of a second cross-sectional area smaller than the first cross-sectional area. A cross-sectional area between the base portion and the tip portion decreases in a substantially continuous manner in a direction from the base portion to the tip portion.

16 Claims, 9 Drawing Sheets

POSTING LADDER

TECHNICAL FIELD

The disclosure relates generally to a ladder requiring securement at a distal or upper end thereof and more particularly relates to a ladder used for "posting" or hanging advertisements on outdoor advertising billboards.

BACKGROUND

Examples of ladders requiring securement at a distal or upper end thereof are shown, for example, in U.S. Pat. No. 1,205,594 issued to Close and titled "Scaling Ladder," U.S. Pat. No. 2,448,716 issued to Hurd and titled "Hook Attachment for Ladders," U.S. Pat. No. 4,279,327 issued to Warren and titled "Ventilating Ladder," U.S. Pat. No. 4,531,613 issued to Keigher for a "Firefighter's Ladder," and U.S. Pat. No. 6,167,988 issued to Frodge et al. for a "Lineman's Ladder Stabilizer". In each of these patented inventions, hooks are provided at an upper end of each of the left and right ladder rails to secure an upper end of the ladder rails to an object being worked on, such as a roof top, support arm, or cable. In various aspects, these hooks are provided with sharp points to permit the tip of the hook to penetrate a surface and provide further stability, a feature that is particularly beneficial for firefighter's.

Additional examples of ladders requiring securement at a distal or upper end thereof are found in the posting ladder art, such as the Stokes Ladders, Inc., Model Nos. 1300-1400 Billboard Posting Ladders or Featherlite Industries, Ltd. 6700 series billboard ladders. Similar posting ladders are manufactured by Formetco and Green Bull. Conventional posting ladders 10 typically come in either a straight or tapered form, such as shown in FIGS. 1(*a*)–(*b*), respectively. These ladders 10 are typically hooked over the top of a billboard 20 and the bottom end of the ladder is permitted to hang freely without vertical support, such as shown in FIG. 1(*c*). Often the bottom end of the ladder is displaced horizontally from the billboard by a catwalk 30, which projects laterally from the bottom of the billboard 20 generally between about one and six feet, six feet being typical. The hooks 40 used in these conventional posting ladders are generally made from aluminum bar or tubing and are generally about ¾" diameter (solid hook) and a 1⅛" diameter (tubular hook).

FIGS. 2(*a*)–2(*b*) respectively show an isometric view of a conventional ladder hook 40 configuration and a corresponding view showing the stress field in a conventional, solid ladder hook during application of a point force in the middle of the hook. For an applied load of 2,500 lbf. applied to a midpoint of the hook 40, as shown by the upwardly-pointing arrow, the stress between the tip of the hook 42 and the point of force application (i.e, an arc subtending an angle of roughly 90°, wherein the 0° point is defined at the tip of the hook) is substantially zero, as is expected. Along the remainder or intermediate portion 43 of hook 40 between the point of force application and the base portion of the hook 44, disposed roughly 180° to the tip of the hook, the stress rises to a value of about $2.5\times10^5$ psi (250,000 psi) over a broad region and achieves a maximum tensile stress of between about $2.5\times10^5$ psi to $3.15\times10^5$ psi (280,000–315,000 psi) occurring along an inner surface of the hook. Stresses around the uppermost attachment hole 45 (e.g., screw or rivet hole) which receives the mechanical connection member (e.g., screw or rivet) are uniformly in the range of about $1.4\times10^5$ psi to $1.7\times10^5$ psi (140,000–170,000 psi).

However, failure of a single hook instantly places significant stresses on the remaining hook, resulting in strains that predictably lead to the rapid failure of the remaining hook. In many instances, such failure leads to disengagement of the ladder from the adjacent surface and collapse of the ladder, as the hooks are typically the only means by which the ladder is vertically secured. In the case of posting ladders, for example, the ladder would simply slide off of the billboard and catwalk to the ground below. Clearly, should a ladder hook fail, the risk for injury to lineman, firefighters and/or fire victims, and billboard workers is significant.

Thus, a need exists for improvement to the hooks used to secure the general class of ladders requiring securement at a distal or upper end thereof to further enhance the structure and performance of the hook and to correspondingly provide enhanced stability of the folding ladder.

SUMMARY

In one aspect, there is provided a hook attachment for a ladder comprising a pair of curved members, each of the curved members being formed in a tapered shape having a base portion of a first cross-sectional area and a tip portion of a second cross-sectional area smaller than the first cross-sectional area. A cross-sectional area between the base portion and the tip portion decreases in a substantially continuous manner in a direction from the base portion to the tip portion.

In another aspect, a hook attachment for a ladder is provided comprising a pair of curved members, each of the curved members having a base portion configured for connection to a ladder side rail, a bent tip portion configured for engagement with a work surface, and an intermediate portion therebetween being tapered between the tip portion and the base portion.

In still another aspect, a hooked ladder is provided and comprises a pair of opposing side rails having a plurality of rungs disposed substantially in parallel therebetween along substantially an entire length of the opposing side rails and a curved member connected to a top end of each of the side rails to extend in a common direction substantially perpendicular to the side rails. Each of the curved members is formed in a tapered shape having a base portion of a first cross-sectional area, a tip portion of a second cross-sectional area smaller than the first cross-sectional area, and an intermediate portion between the tip portion and the base portion, the intermediate portion having a cross-sectional area that gradually decreases between the first cross-sectional area and the second cross-sectional area.

Additional advantages will become readily apparent to those skilled in this art from the following detailed description, wherein only the a preferred example of the present concepts are shown and described. As will be realized, the disclosed concepts are capable of other and different embodiments, and its several details are capable of modifications in various obvious respects, all without departing from the spirit thereof. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

Herein provided is an improved ladder hook for ladders requiring securement at a distal or upper end. Although the illustrated example relates to the advantageous embodiment of a billboard posting ladder, it is to be understood that the disclosed ladder hook is also applicable to other types of ladders requiring securement at an upper end.

Figure 3A:
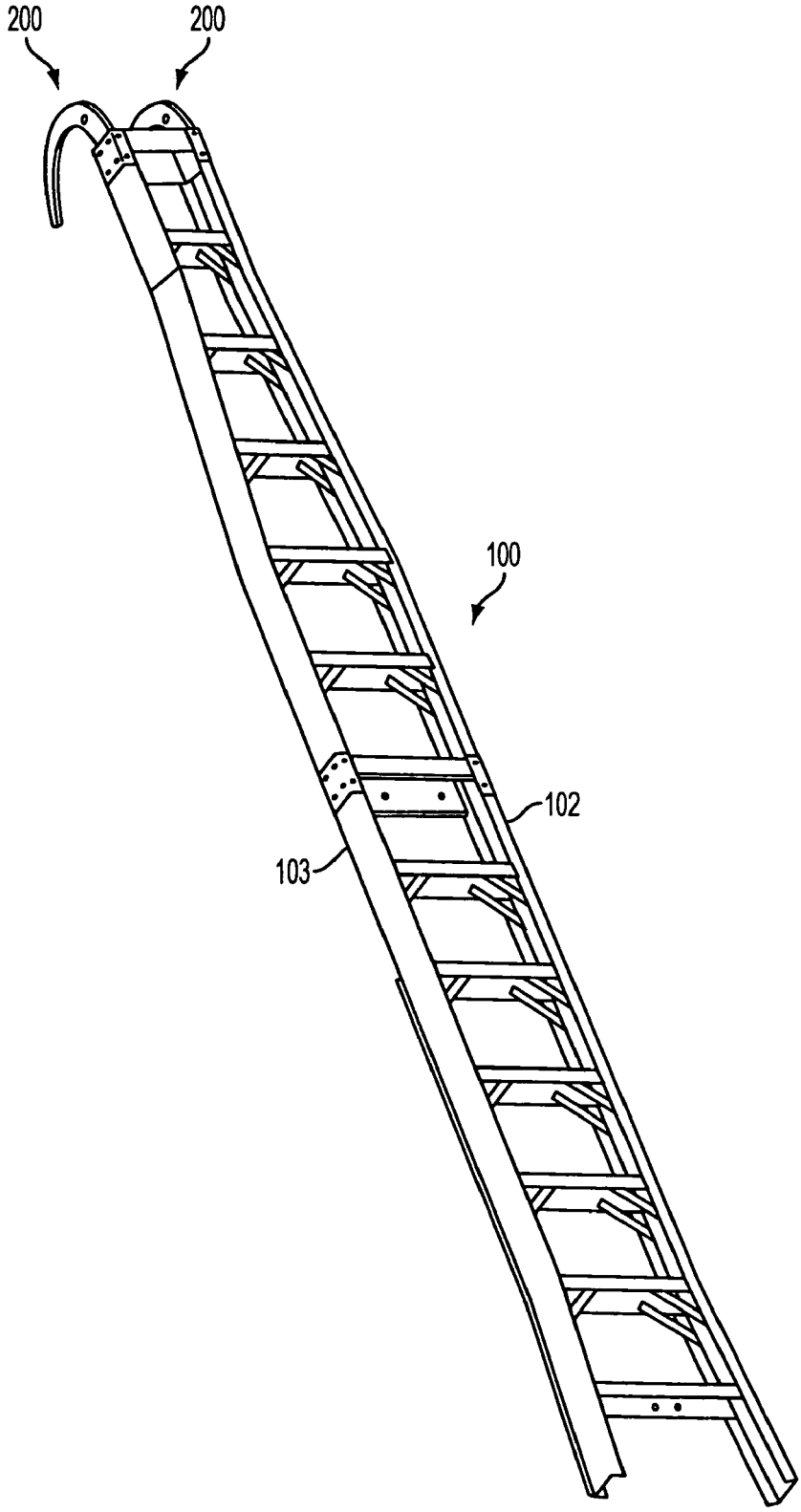
FIGS. 3(*a*)–3(*b*) respectively show a front and a rear isometric view of a tapered posting ladder in accord with the present concepts.
Figure 3B:
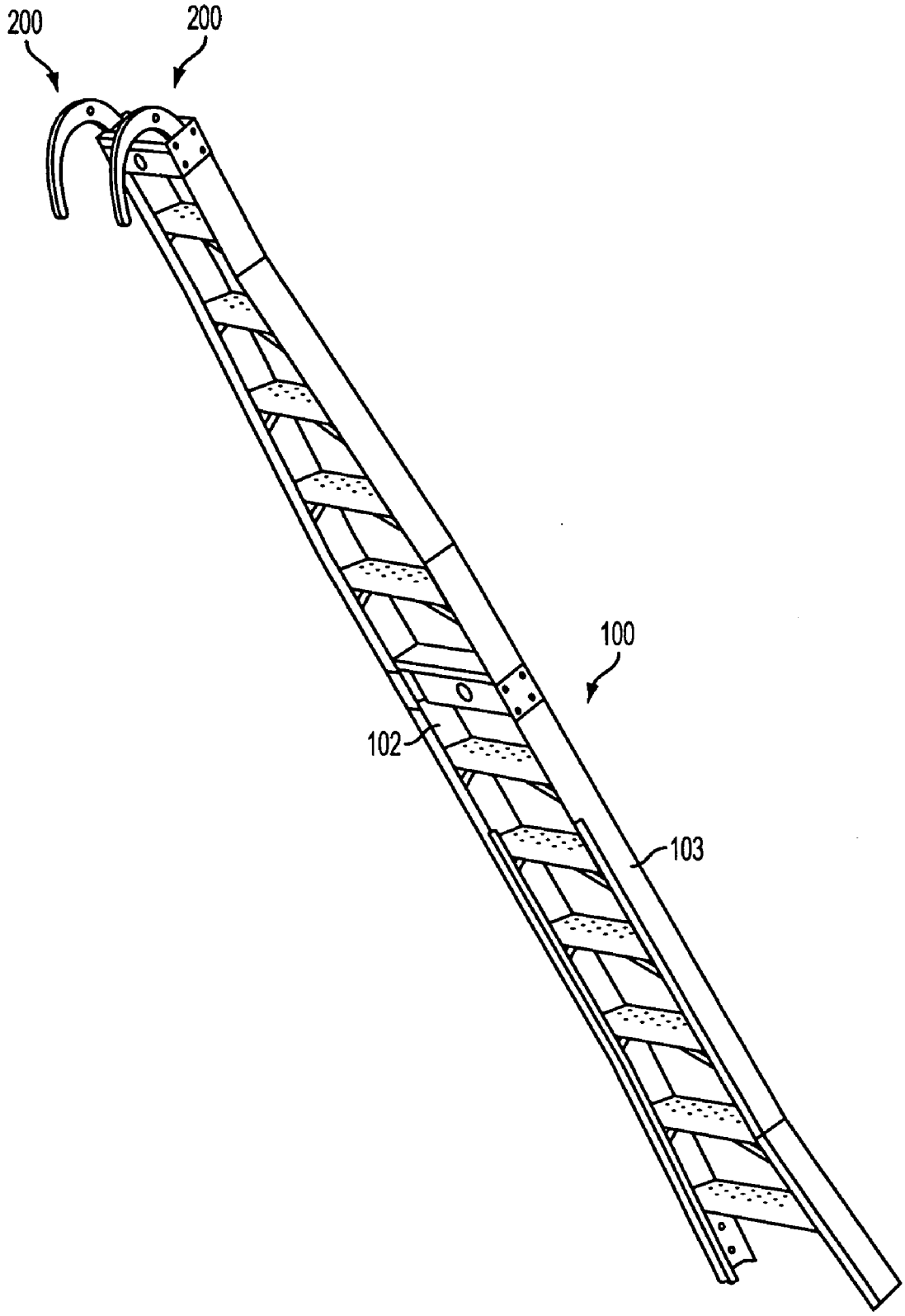

FIGS. 3(*a*)–3(*b*) respectively show a front and a rear isometric view of a tapered posting ladder 100 in accord with the present concepts. As with other types of ladders, which may also advantageously utilize the hook 200 disclosed herein, these ladders 100 are typically formed from aluminum, fiberglass, or pultruded or extruded resinous (e.g., thermosetting or thermoplastic) materials. In various aspects, the overall length of the ladder 100, as measured by the ladder rails 102, 103, is advantageously selected to be between 13' and 22', with 14' and 16' being preferred lengths and with lengths of 18' and 20' also being desirable. As with conventional tapered posing ladders 10, the upper portion of ladder 100 is inwardly tapered. This tapering may occur at the upper 5' feet of the ladder 100 length, or at any other arbitrary point. The degree of the taper would be changed in accord with the starting point of the inward taper along the ladder 100 length so as to provide a ladder step of suitable width at the upper extents of the ladder. Additionally, an outward taper may be provided at a bottom portion of the ladder 100. Again, the outward taper may occur at the lower 5' feet of the ladder length, or at any other arbitrary point, with the degree of the taper selected so as to provide a manageable ladder width and to ensure stability of the ladder 100 base.

Figure 4A:
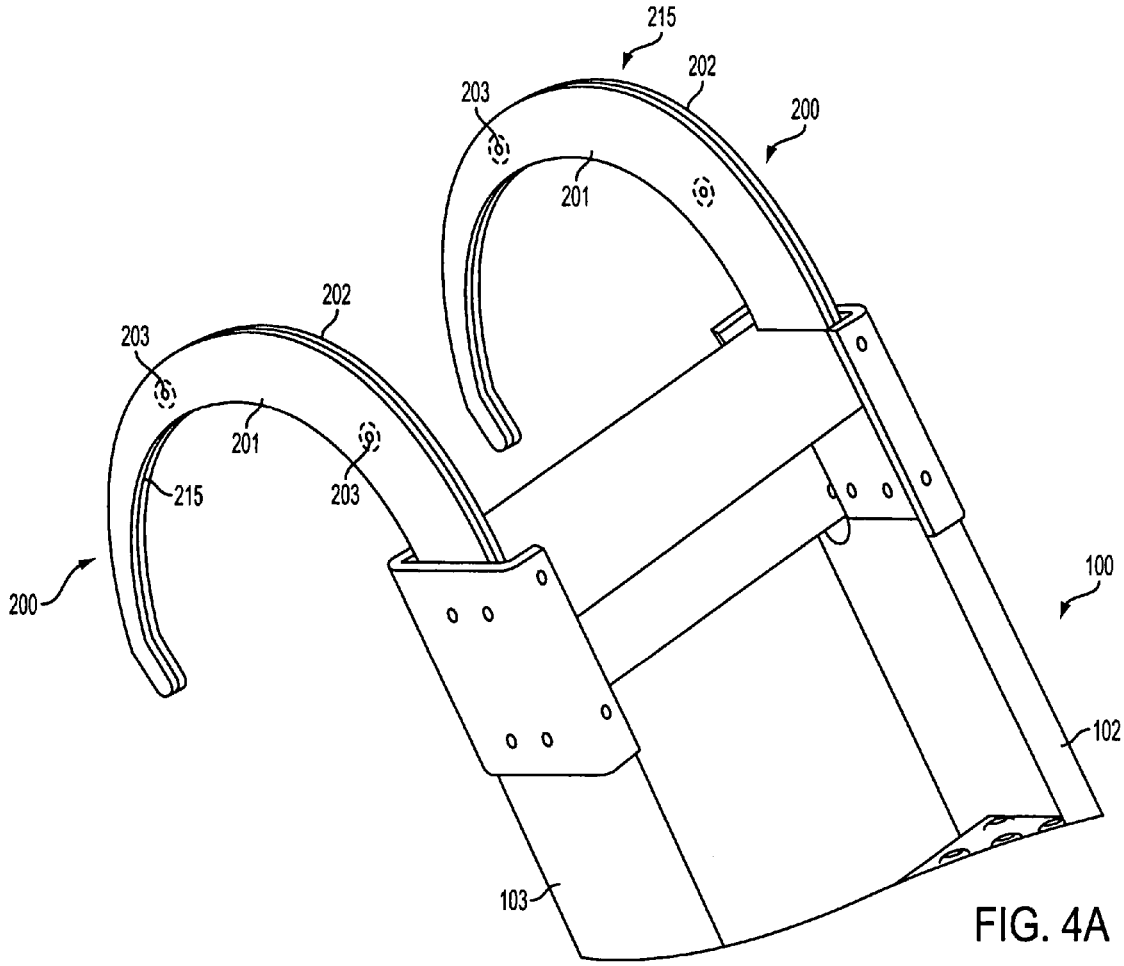
FIGS. 4(*a*)–4(*b*) respectively show a front and a rear isometric view of ladder hooks in accord with the present concepts disposed on the tapered posting ladder shown in FIGS. 2(*a*)–(*b*).
Figure 4B:
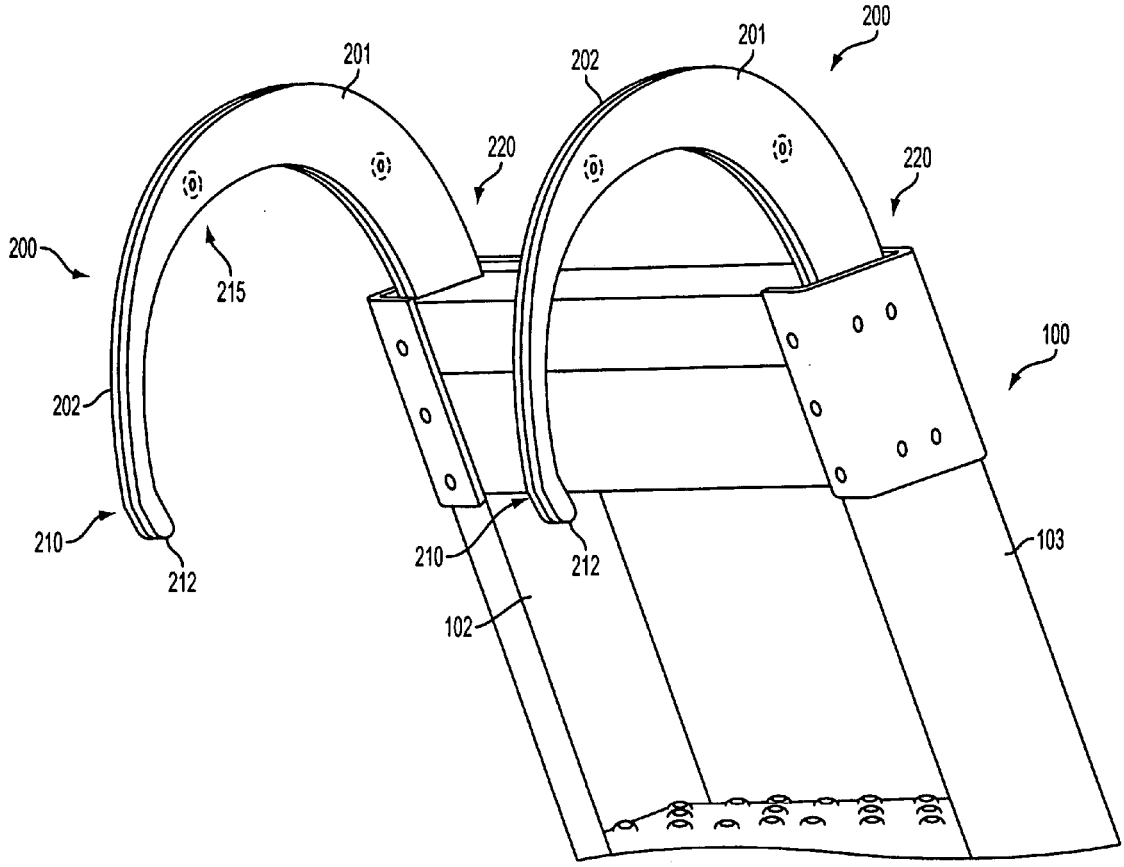
Figure 5:
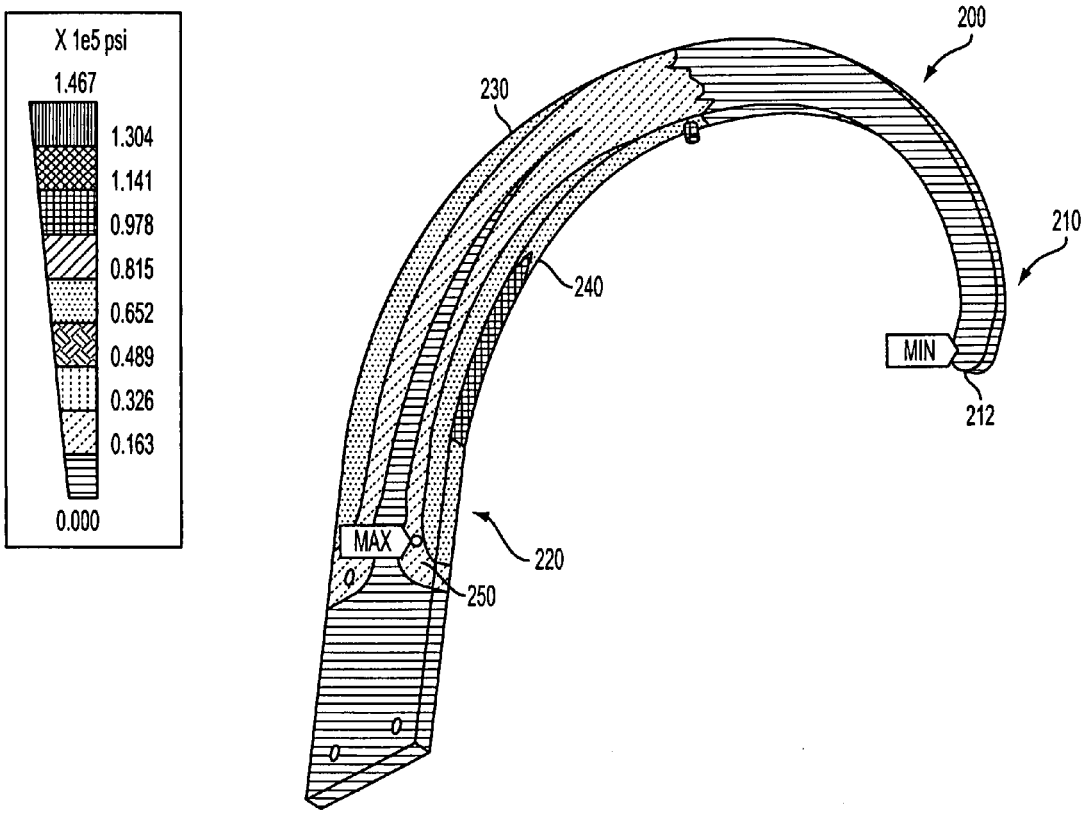
FIG. 5 shows an isometric view of a ladder hook in accord with the present concepts showing the stress field during application of a point force in the middle of the hook.

FIGS. 4(*a*)–4(*b*) are front and a rear isometric views of the ladder hooks 200 used in the tapered posting ladder 100 shown in FIGS. 3(*a*)–3(*b*). In lieu of the uniform circular cross-section evident in the conventional designs, the ladder hook 200 in accord with the present concepts is tapered along its cross-section from a distal end or tip portion 210 of the hook to a proximal end or base portion 220 of the hook. This taper provides an evenly distributed stress along the length of the hook 200, as shown in FIG. 5.

For an applied load of 2,500 lbf. applied to a midpoint of the hook 200, as shown by the upwardly-pointing arrow, the stress between the tip of the hook 212 and the point of force application (i.e, an arc subtending an angle of roughly 90°, wherein the 0° point is defined at the tip of the hook) is substantially zero, as would be expected. Along the remainder of the hook 200 between the point of force application and the base portion 212 of the hook 200, disposed roughly 180° to the tip 212 of the hook, the stress follows a somewhat hyperbolic pattern from the upper surface 230 and lower surface 240 inwardly to the center line of the hook. At points between the lower surface 240 of the tapered hook and the center-line of the hook, the stresses drop rapidly in a direction toward the center-line of the hook. At the lower surface 240 of the hook, the measured tensile stress is about $0.90\times10^5$ psi (90,000 psi) and decreases to between about $0.65\times10^5$ psi and $0.16\times10^5$ psi (65,000 psi and 16,000 psi) at about a mid-point of the distance between the lower surface of the tapered hook and the center-line of the hook. Between this mid-point and the center-line of hook 200, the stresses drop of from about to a substantially zero-stress condition along the hook center-line.

Figure 1A:
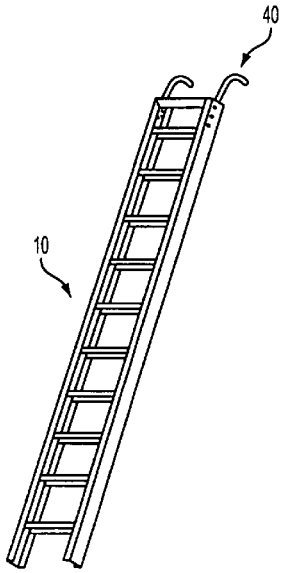
FIGS. 1(*a*)–1(*c*) are perspective views of a conventional straight posting ladder, a conventional tapered posting ladder; a conventional straight posting ladder attached to a billboard.
Figure 1B:
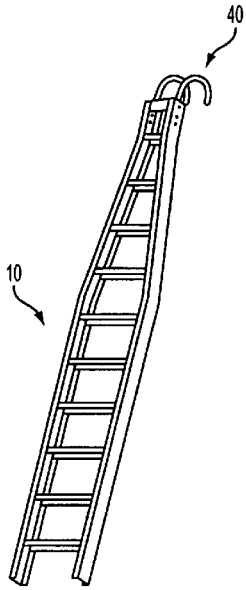
Figure 1C:
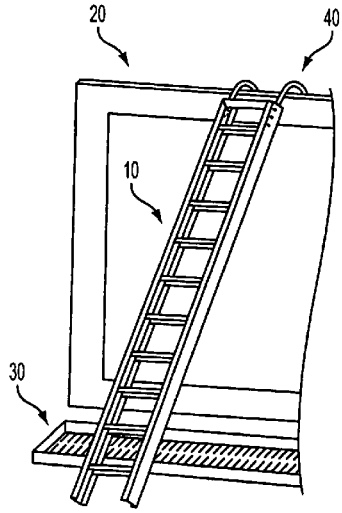
Figure 2A:
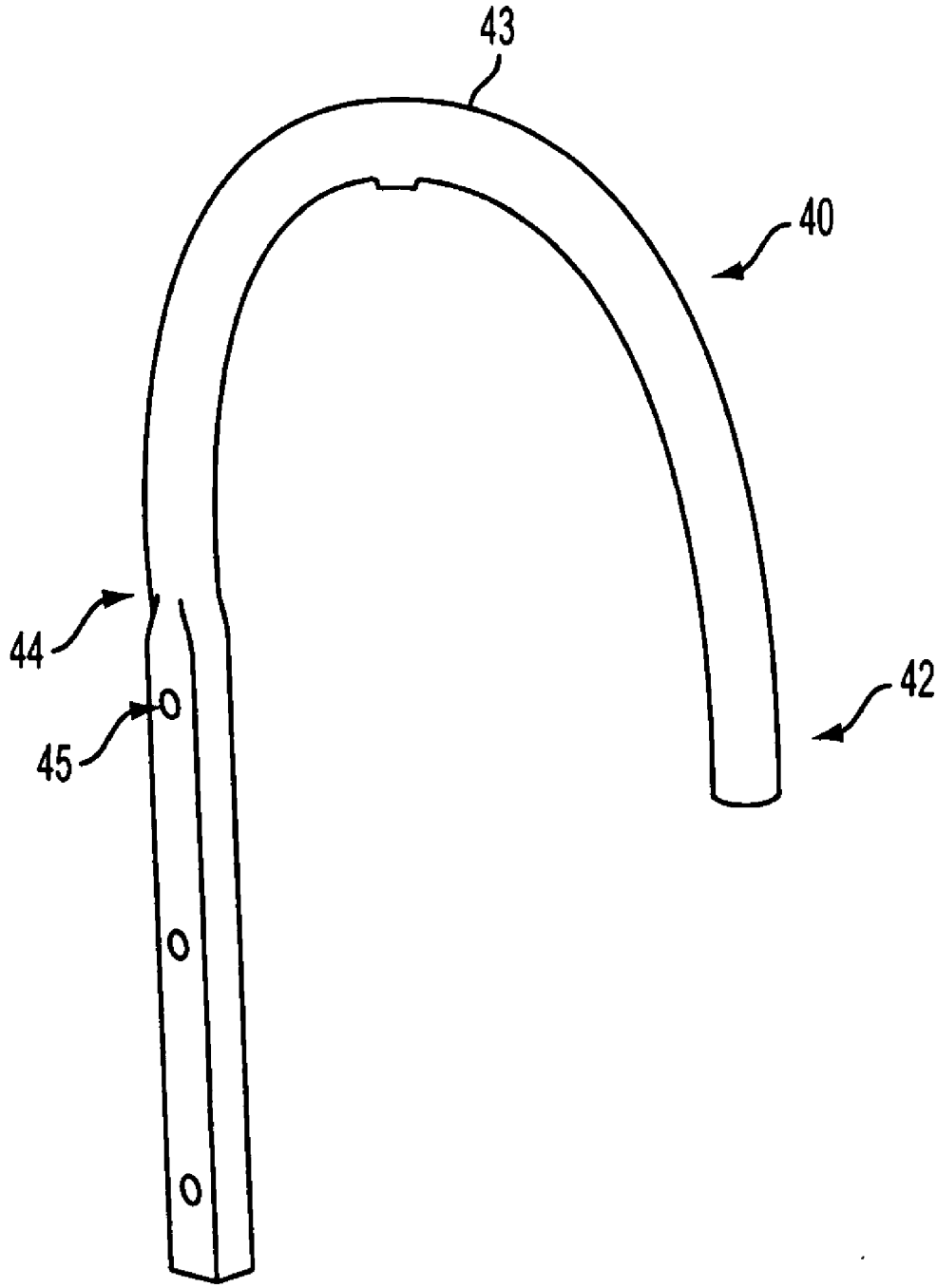
FIGS. 2(*a*)–2(*b*) respectively show an isometric view of a conventional ladder hook configuration and a corresponding view showing the stress field in the conventional ladder hook during application of a point force in the middle of the hook.
Figure 2B:
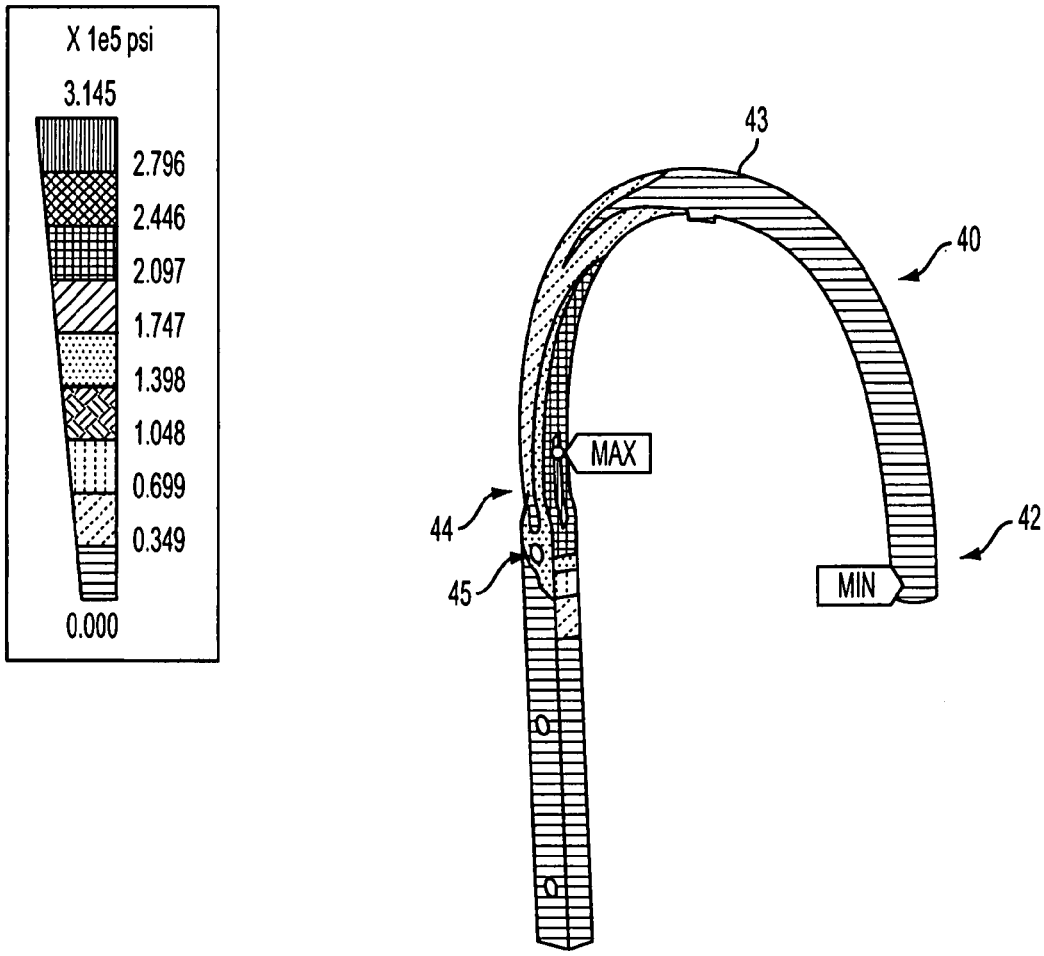

On the other side of the hook 200, the maximum compressive stress in the upper surface 230 is about $0.65\times10^5$ psi (65,200 psi) and decreases rapidly to a value of roughly $0.16\times10^5$ psi (16,000 psi) at about a mid-point of the distance between the upper surface of the tapered hook and the center-line of the hook. Between this mid-point and the center-line of the hook 200, the stresses drop of from about to a substantially zero-stress condition along the hook center-line. Thus, the stress in the hook 200 rises to a maximum of about 90,000 psi (in tension) along an inner surface 240 of the hook and into one of the rearwardly disposed, as depicted, attachment holes (e.g., screw or rivet holes) 250 used to secure the hook to the ladder rails. The behavior of the hook 200 in accord with the present concepts is contrasted with that of the conventional ladder hooks 40, such as those used in a posting ladder 10, discussed in relation to FIG. 2(*b*).

Thus, the present inventors have determined that the conventional constant diameter hooks are subjected to increased loads between the base portion of the hook and a mid-point of the hook and, more particularly, on an inside surface near the base portion of the hook. To mitigate potential stress risers, which can lead to the premature failure of the hook, the present inventors have devised a new hook structure which more evenly distributes the stresses imparted by a point or distributed applied force applied to the hook.

The hook 200 in accord with the present concepts includes, for the posting ladder 100 application, an optional bent tip 212 that is slightly angled inwardly back toward the base of the hook. In one aspect, this inward bend is sufficient to cross-back over the vertical by an angle of roughly 13°–14°. The tip is optionally blunted or rounded. The shape of the bent tip 212 is such that it may pass vertically through mesh-type openings in a grating or standard expanded aluminum sheet catwalk walking surface provided on a top portion of some billboards when the ladder 100 is held at a predetermined angle or range of angles away from the lower catwalk surface. In other words, the bottom portion of the ladder 100 is held laterally away from billboard or lower catwalk walking surface at a second distance greater than the "as-used" first distance, which is substantially equal to the distance of the outer edge of the lower catwalk from the billboard. After the bent tip 212 has passed through such opening, which is typically a diamond-shaped or rhomboidal opening having a lateral dimension of about 0.70 inches and a longitudinal dimension of about 1.64 inches, the ladder 100 may rotated to so that the bottom portion of the ladder is resting against the outer edge of the lower catwalk. When the ladder 100 is rotated to the "as-used" position, the bent tip 212 correspondingly rotates under the mesh-type opening to provide an added degree of securement. Alternately, the bent tip 212 may be canted in the opposite or outward direction, or may be omitted in favor of a tip that follows the general curvature of the remainder of the hook 200.

In the illustrated example of a hook 200 in accord with the present concepts, the tapering of the hook is provided along substantially an entire length of the hook body. Thus, in accord with the present concepts, there is provided a hook 200 for a ladder 100 formed in a tapered shape having a base portion 220 of a first cross-sectional area and a tip portion 210 of a second cross-sectional area smaller than the first cross-sectional area, and wherein a cross-sectional area between the base portion and the tip portion decreases in a direction from the base portion to the tip portion. In one aspect, the decrease in cross-sectional area between the base portion 220 and the tip portion 210 decreases in a direction from the base portion to the tip portion is substantially constant. However, particularly as evident by FIG. 4(*a*), the portion of the hook 200 from the point of predicted force application, which may or may not coincide with a mid-point of the hook, to the distal end or tip 212 of the hook experiences almost no stress. Thus, it is not necessary for this portion of the hook 200 to be tapered. However, continuity in the hook 200 tapering eases formability of the hook, presents an aesthetically pleasing product, and provides flexibility in the event that the actual force application deviates from that illustrate in the examples provided herein.

Figure 6:
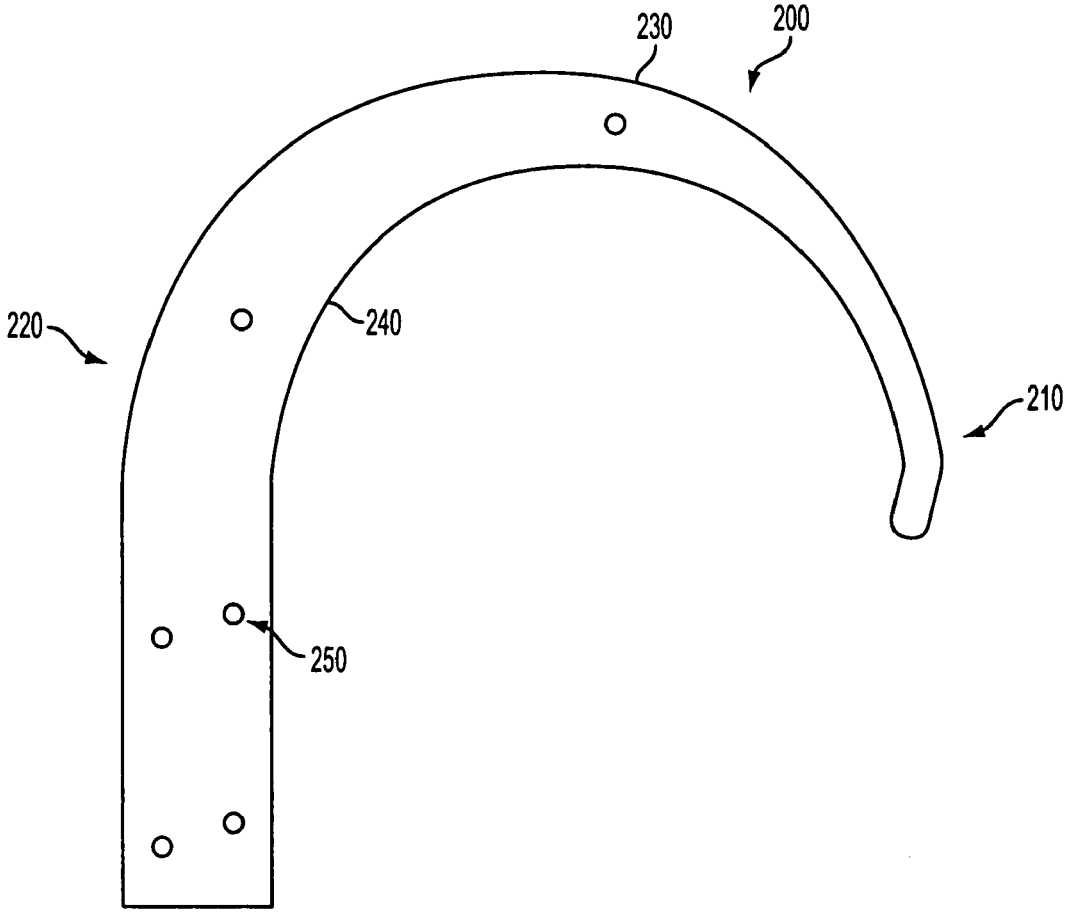
FIG. 6 shows a side view of a ladder hook in accord with the present concepts.

Although the hook 200 in accord with the present concepts could comprise a single curved plate, the hook may advantageously comprise a plurality of curved plates 201, 202 connected to one another, such as by various types of welding, lamination or bonding, or by mechanical fasteners (e.g., screw, rivet, bands, clips), or other conventional means of attaching metal components, such as shown in FIGS. 4(*a*)–4(*b*). In this example, two plates 201, 202 of 6061-T6 aluminum having a thickness of about 0.250" are joined together by rivets 203. The cross-section of the hook 200 assembly is substantially rectangular at the base portion 220 of the hook and intermediate portion of the hook 215, but assumes a generally square shape toward the tip portion 210. As shown in FIG. 6, at least one connecting member 250 configured to receive a conventional fastening member (e.g., mechanical fasteners such as screws, rivets, bands, clips, notches, protrusions) is provided to enable the hook 200 to be attached to a corresponding feature of an associated ladder rail 102, 103. In the example of FIGS. 3(*a*)–4(*b*), hooks 200 are provided with holes 250 to receive screws or rivets.

FIG. 6 shows an example of an engineering drawing for a ladder hook 200 in accord with the present concepts. The illustrated hook 200 is defined by a curved member comprising an upper surface 230 defined by a first radius of curvature (R5.625 in.) centered about a first origin $O_1$ and a lower surface 240 defined by a second radius of curvature (R4.375) centered about a second origin $O_2$. In the illustrated example, the second origin $O_2$ is displaced laterally from the first origin $O_1$ by about 0.75 inches in a direction toward the tip portion 210 of the hook 200. The upper surface 230 and lower surface 240 are not limited to this configuration and may each comprise plural radii of curvature or may be defined by a non-circular curvature.

The invention disclosed herein can be practiced by employing conventional materials, methodology and equipment. Accordingly, the details of such materials, equipment and methodology are not set forth herein in detail. In the previous descriptions, numerous specific details of one preferred example, such as specific materials, structures, etc., are set forth to provide a grounding in the present invention. However, it should be recognized that the present invention can be practiced without resorting to the details specifically set forth. In other instances, well known processing structures have not been described in detail, in order not to unnecessarily obscure the present invention. It is to be understood that the present invention is capable of use in various other combinations and environments and is capable of changes or modifications within the scope of the inventive concept as expressed herein.

We claim:

1. A hook attachment for a ladder, comprising:

a pair of curved members, wherein each of the curved members is formed in a tapered shape having a base portion of a first cross-sectional area and a tip portion of a second cross-sectional area smaller than the first cross-sectional area, wherein a cross-sectional area between the base portion and the tip portion decreases in a substantially continuous manner in a direction from the base portion to the tip portion, and each of the curved members having a base portion configured for direct, fixed connection to a ladder side rail, and each of the curved members comprising a plurality of curved plates connected to one another.

2. A hook attachment for a ladder in accord with claim 1, wherein each of the curved members comprises a single curved plate.

3. A hook attachment for a ladder in accord with claim 1 or 2, wherein each of the curved members is substantially flat along one axis.

4. A hook attachment for a ladder in accord with claim 3, wherein a perimeter of the base portion first cross-sectional area is substantially rectangular.

5. A hook attachment for a ladder in accord with claim 4, wherein a perimeter of a cross-sectional area between the first cross-sectional area and the second cross-sectional area is substantially rectangular.

6. A hook attachment for a ladder in accord with claim 5, further comprising at least one connecting member disposed at the base portion of each of the curved members.

7. A hook attachment for a ladder in accord with claim 6, wherein the at least one connecting member is a through hole configured to receive a mechanical fastener.

8. A hook attachment for a ladder in accord with claim 1, wherein the tip portion is rounded.

9. A hook attachment for a ladder in accord with claim 8, wherein the tip portion is angled inwardly.

10. A hook attachment for a ladder in accord with claim 1, wherein the curved members traverse an arc of between about 180°.

11. A hook attachment for a ladder in accord with claim 1, wherein the curved members comprise an upper surface defined by a first radius of curvature centered about a first origin and a lower surface defined by a second radius of curvature centered about a second origin, and wherein the second radius of curvature is smaller than the first radius of curvature.

12. A hooked ladder, comprising:

a pair of opposing side rails having a plurality of rungs disposed substantially in parallel therebetween along substantially an entire length of the opposing side rails; and a curved member connected to a top end of each of the side rails at a base portion of the curved member to extend in a common direction substantially perpendicular to the side rails, wherein each of the curved members is formed in a tapered shape having a first cross-sectional area at the base portion, a tip portion of a second cross-sectional area smaller than the first cross-sectional area, and an intermediate portion between the tip portion and the base portion, the intermediate portion having a cross-sectional area that gradually decreases between the first cross-sectional area and the second cross-sectional area; and wherein a perimeter of the base portion first cross-sectional area and a perimeter of the cross-sectional area of the intermediate portion are both substantially rectangular, and wherein the tip portion is rounded.

13. A hooked ladder in accord with claim 12, wherein each of the curved members comprises a curved plate.

14. A hooked ladder in accord with claim 13, wherein each of the curved members is substantially flat along one axis.

15. A hooked ladder in accord with claim 12, wherein the tip portion is angled inwardly.

16. A hooked ladder, comprising:

a pair of opposing side rails having a plurality of rungs disposed substantially in parallel therebetween along substantially an entire length of the opposing side rails; and a curved member connected to a top end of each of the side rails to extend in a common direction substantially perpendicular to the side rails, wherein each of the curved members is formed in a tapered shape having a base portion of a first cross-sectional area, a tip portion of a second cross-sectional area smaller than the first cross-sectional area, an intermediate portion between the tip portion and the base portion, the intermediate portion having a cross-sectional area that gradually decreases between the first cross-sectional area and the second cross-sectional area, and wherein each of the curved members comprises a plurality of curved plates connected to one another.

* * * * *